US007694633B2

(12) United States Patent
Mayer

(10) Patent No.: US 7,694,633 B2
(45) Date of Patent: Apr. 13, 2010

(54) ANTI-CLIMBING DEVICE FOR RAILAY CARRIAGES

(75) Inventor: Wilhelm Mayer, Gänserndorf (AT)

(73) Assignee: Siemens Transportation Systems GmbH & Co KG, Viena (AT)

( * ) Notice: Subject to any disclaimer, the term of this patent is extended or adjusted under 35 U.S.C. 154(b) by 545 days.

(21) Appl. No.: 10/560,222

(22) PCT Filed: Apr. 7, 2004

(86) PCT No.: PCT/AT2004/000122

§ 371 (c)(1),
(2), (4) Date: Aug. 15, 2007

(87) PCT Pub. No.: WO2004/110842

PCT Pub. Date: Dec. 23, 2004

(65) Prior Publication Data

US 2008/0006173 A1 Jan. 10, 2008

(30) Foreign Application Priority Data

Jun. 13, 2003 (AT) ..... A 917/2003

(51) Int. Cl.
*B21D 15/06* (2006.01)

(52) U.S. Cl. ..... 105/392.5; 105/402; 105/421

(58) Field of Classification Search ..... 106/1.4, 106/5, 6, 392.5, 402, 421
See application file for complete search history.

(56) References Cited

U.S. PATENT DOCUMENTS

| | | | | |
|---|---|---|---|---|
| 6,712,007 | B2 * | 3/2004 | Yamamoto et al. | 105/392.5 |
| 6,820,759 | B1 * | 11/2004 | Schindler et al. | 213/221 |
| 2008/0250965 | A1 * | 10/2008 | Clark et al. | 105/413 |
| 2008/0314282 | A1 * | 12/2008 | Malfent et al. | 105/392.5 |

FOREIGN PATENT DOCUMENTS

| | | |
|---|---|---|
| DE | 43 43 800 A1 | 6/1995 |
| DE | 199 56 856 A1 | 5/2001 |
| FR | 2 698 840 | 12/1992 |

* cited by examiner

*Primary Examiner*—S. Joseph Morano
*Assistant Examiner*—Zachary Kuhfuss
(74) *Attorney, Agent, or Firm*—Thomas R. Vigil

(57) ABSTRACT

The invention relates to an anti-climbing device (2) for railway carriages, which is fixed at least at one end of the carriage at a defined height and extends over at least part of the carriage width. To co-operate with the end section of an anti-climbing device of another carriage in the event of a crash, said device is provided with a central cut-out section (5), open on the underside and delimited on the upper side by an interception surface, said section being located beneath a central protruding end section (4), in addition to two centering surfaces (8) that laterally delimit the section (5). An essentially horizontal fixing surface (9) adjoins the lower edge of each centering surface.

9 Claims, 7 Drawing Sheets

ANTI-CLIMBING DEVICE FOR RAILAY CARRIAGES

The invention relates to an anti-climbing device for railway carriages which is fixed at least at one end of the carriage at a defined height and extends over at least part of the carriage width.

An anti-climbing device of this kind, as it has become known for example from U.S. Pat. No. 4,184,434, is intended to prevent one car body from being pushed over the other one with a certain height offset thus causing serious destructions to the passenger compartment in the event of a rear-end collision between two railway carriages.

Figure 2:
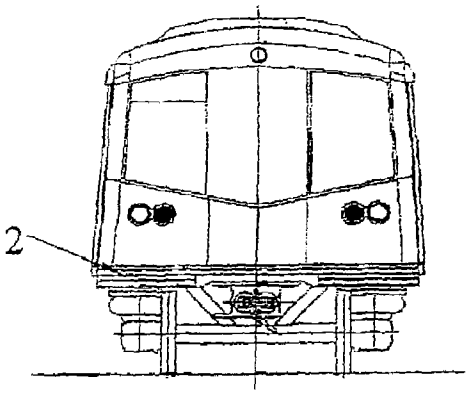
Figure 1:
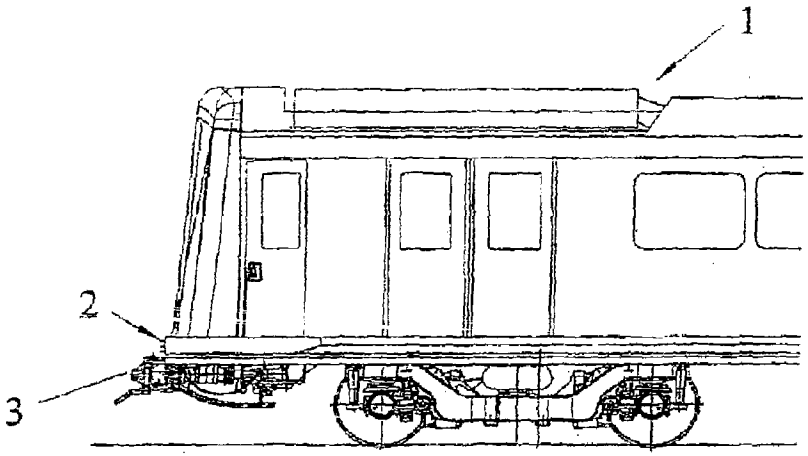
Figure 3:
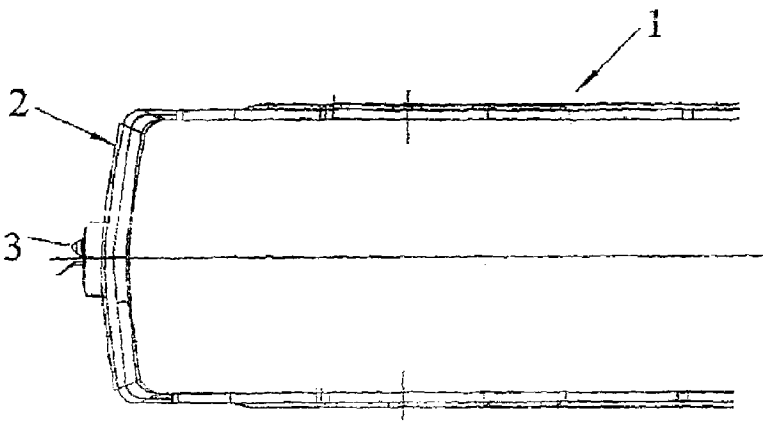

Usually, anti-climbing devices have a plurality of parallel and horizontal ribs, as can be seen from the FIGS. 1 through 3 illustrating the state of the art for example. On the partially illustrated railway carriage 1, an anti-climbing device 2 extending substantially across the entire side of the carriage is disposed at its two ends in such a manner that, in the event of a collision, the forces can be introduced into the carrier region of the carriage. In the region of the coupling 3, the anti-climbing device 2 is configured to be narrower or disrupted. As shown in the FIGS. 1 through 3, the anti-climbing device 2 projects beyond the front wall of the carriage. At need, it may have a facing such as made from glass fiber reinforced plastic which is due to destruction before two anti-climbing devices interengage in the event of a collision.

Known anti-climbing devices almost always compete with the coupling for in most cases, once the height of the coupling and the height of the carriage floor have been fixed, there remains little space for an anti-climbing device when taking into account the movements of the coupling. This can be seen e.g., from the images 1, 5 and 6 in the article "Herstellung von Schienenfahrzeugen" (*Manufacturing of Railway Carriages*) in ZEV+DET Glas. Ann. 123 (1999) from which it can be seen that the anti-climbing device merely consists of two lateral buffers provided with horizontal ribs.

On vehicles with rounded carriage ends and a continuous anti-climbing device, the superimposition of the anti-climbing devices of two carriages involved in an accident is quite reduced, this being due to the curvature. This problem is exacerbated on vehicles having strongly rounded carriages ends which are not provided with a continuous anti-climbing device. In the event of an accident, this results in poor and non-defined engagement of the anti-climbing devices and questions their efficiency.

Another problem that is to be addressed is that the overall height of the anti-climbing devices is limited—for example because of the coupling—but that, on the other side, it cannot be anticipated that the anti-climbing devices of two colliding carriages will be on exactly the same height in the event of an accident.

The problems mentioned either result in a complete failure of the anti-climbing device or in the forces being introduced in an undefined manner, thereby at least partially by-passing the sacrificial elements usually mounted in railway carriages.

One object of the invention is to provide an anti-climbing device or a corresponding railway carriage in which the above-mentioned disadvantages have been eliminated as far as practicable.

This object is achieved by providing an anti-climbing device of the type mentioned herein above in which, for cooperation with the front portion of the anti-climbing device of another carriage in a rear-end collision situation, a central cutout, which is open toward the bottom and bounded by a guard surface toward the top, and two centering surfaces laterally bounding the cutout are provided according to the invention beneath a projecting central front portion, a substantially horizontal fixing surface adjoining the lower end of each centering surface.

Even if the height offset between two colliding carriages is quite important, the invention allows for secure snap-fit of the two involved anti-climbing devices and for guard effect in the vertical direction. In the event of a collision, it is made certain that the anti-climbing devices of colliding carriages also center or block in a lateral horizontal direction, which ensures interengagement and defined introduction of the forces into the undercarriage.

It may be particularly advantageous if the centering surfaces converge inward at an incline with respect to the vertical center plane of the carriage.

In a practical embodiment, there is provided that each fixing surface is formed by the top side of a lateral guard plate.

For reasons of solidity, another advantage is obtained if the centering surfaces and the fixing surfaces are formed by lateral indentations in the anti-climbing device.

It may be practical to provide the anti-climbing device with a front face having ribs.

In order to even further improve the function when two anti-climbing devices involved in a collision are offset in height, there is provided on the underside of the projecting front portion in a variant of the invention a guide surface inclined downward and rearward.

In another, more practical variant of the anti-climbing device, there is provided that its convexly rounded front side extends substantially across the entire width of the carriage, thereby forming the projecting front portion.

Further, in many cases it is practical if it is at least partially covered with a facing that is readily destructible in the event of a collision. Such a facing may provide advantages with respect to aerodynamics, dirt and aesthetics without compromising the protection function as it is easily destroyable.

The subject matter of the invention also is a railway carriage having an anti-climbing device with the features of the invention.

It is thereby advantageous if the centrally projecting front portion is the basis of an intercar connection between railway carriages.

Figure 5:
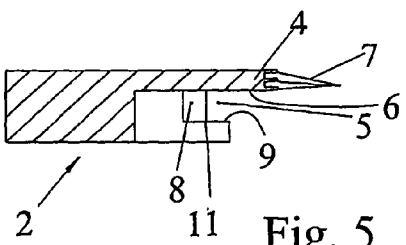
Figure 4:
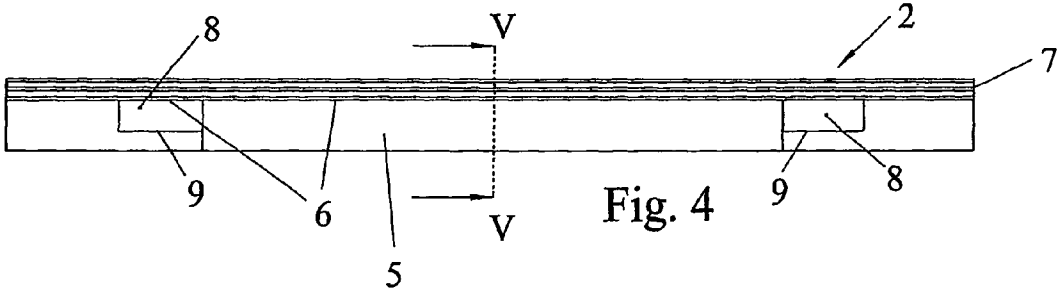
Figure 7:
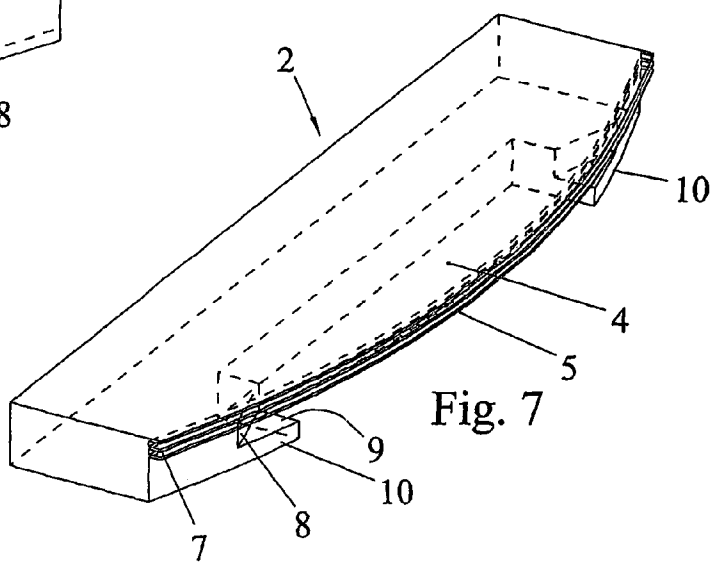
Figure 6:
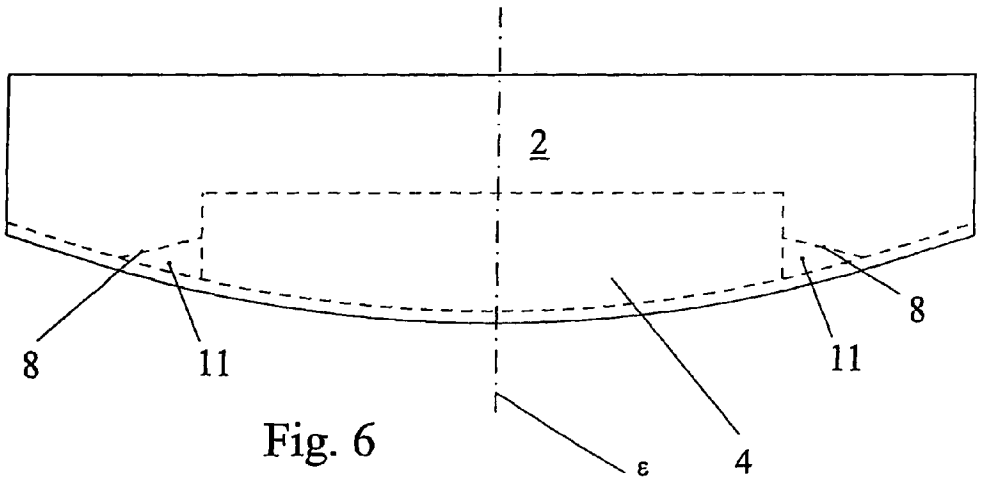
Figure 8:
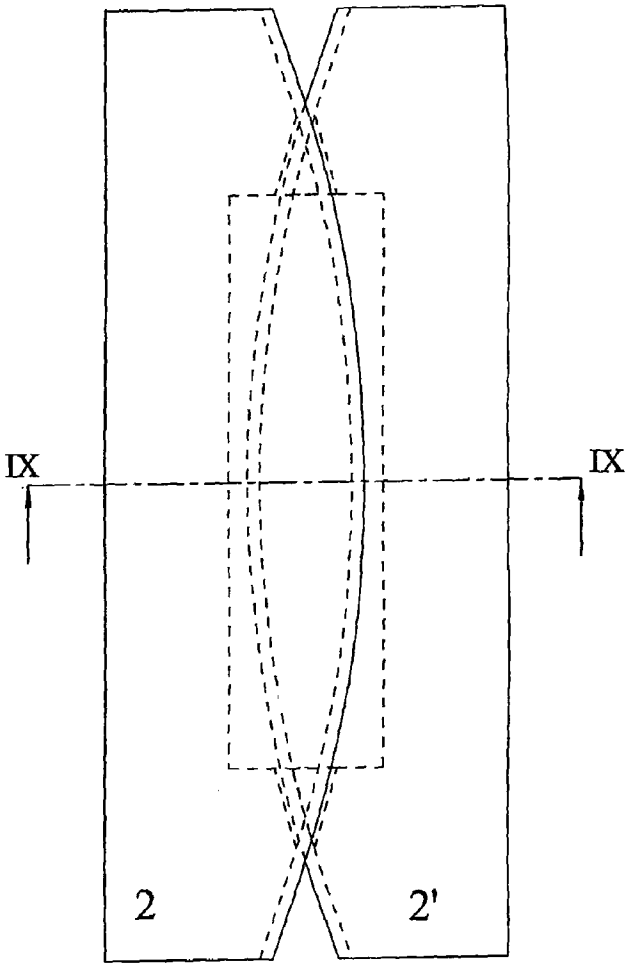

The invention and all the other advantages thereof will be discussed in greater detail herein after with reference to embodiments given by way of example only in conjunction with the drawing. In the drawing:

FIGS. 1 through 3 respectively are a side view, a front view and a top view of an end portion of a railway carriage equipped with a prior art anti-climbing device, FIG. 4 is a front view of a first embodiment of an anti-climbing device of the invention, FIG. 5 is a sectional view taken along line V-V of FIG. 4, FIG. 6 is a top view of the anti-climbing device of FIG. 4, FIG. 7 is a perspective illustration of the anti-climbing device of FIG. 4, FIG. 8 is a top view of anti-climbing devices of the embodiment of FIG. 4 of two colliding railway carriages, FIGS. 9*a* through 9*d* are sectional views along the line IX-IX of FIG. 8 of four different positions the anti-climbing devices are likely to adopt relative to each other in the event of a collision, FIGS. 10 through 15 illustrations analogous to those according to FIGS. 4 through 9 of a second embodiment of an anti-climbing device of the invention and FIGS. 16 through 21 illustrations analogous to those according to FIGS. 4 through 9 or 10 through 15 of a third embodiment of an anti-climbing device of the invention.

Where the invention is herein after described with reference to exemplary embodiments, it should be understood that the anti-climbing devices illustrated are always disposed in an appropriate manner on a railway carriage, namely on one or the two ends thereof and at a height that is in most cases set by national or supranational standards.

On a first embodiment according to the FIGS. 4 through 9, the anti-climbing device 2 has a bulging or projecting central front portion 4 which in this exemplary embodiment results from the convex curvature of the anti-climbing device 2.

Beneath this front portion 4, a central cutout 5 is formed in the anti-climbing device 2, said cutout being open toward the bottom and bounded by a guard surface 6 toward the top. By this arrangement, which will be discussed herein after, cooperation of the front portion 4 of an anti-climbing device with the cutout 5' of another anti-climbing device 2' involved in the collision is made possible.

In this embodiment, the overall anti-climbing device 2 has ribs 7 on the level of the front portion.

Said ribs 7 run horizontally and parallel to each other. Three such ribs 7, of for example 10 mm thick, are provided. Like the remaining anti-climbing device 2, the front portion 4 with its ribs 7 is made from a steel or aluminium alloy or from another material currently used in railbound vehicles.

Underneath the front portion 4, there are provided two lateral centering surfaces 8 which in this exemplary embodiment converge inward at an incline, i.e., away from the end of the carriage with respect to the center plane $\epsilon$ of the carriage. This is evident from FIG. 6 for example.

A substantially horizontal fixing surface 9, which extends toward the front, adjoins the lower end of each centering surface 8. These fixing surfaces 9 are formed by the top sides of two lateral guard plates 10.

In practice, the centering surfaces 8 and the fixing surfaces 9 are formed by additional lateral indentations 11 made in the anti-climbing device 2 (FIG. 5). The surfaces of the lateral indentations confronting the small fixing surface 9 thereby form part of the guard surface 6, which has been outlined by a reference line in FIG. 4.

Figure 9:
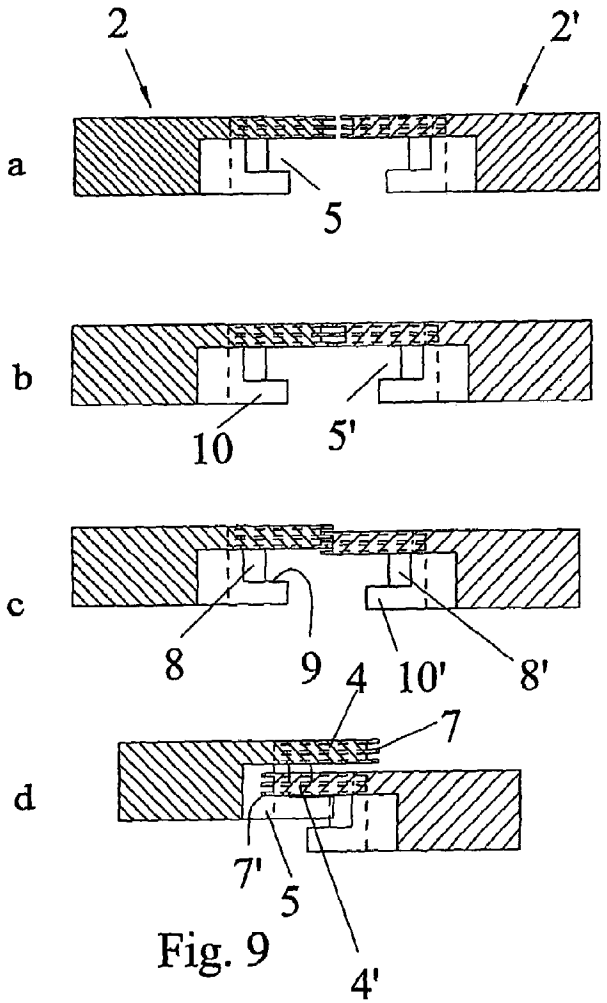

The FIGS. 8 and 9 respectively illustrate the function of the anti-climbing device of the invention, the anti-climbing device of a first railway carriage being labelled at 2 and the one of a second railway carriage, which is the collision partner, being labelled at 2'.

FIG. 9*a* shows the ideal position of the two anti-climbing devices 2, 2' shortly before they get into touching contact with each other and FIG. 9*b*, in the very moment of contacting. The two front portions 4, 4' are on the same height.

The function of the actually always existing height offset is shown in FIG. 9*c* with the ribs 7, 7' intermeshing at the two front portions 4, 4' so that mutual fixation is achieved in the vertical direction.

From the FIGS. 8 and 9*d* it can be seen that thanks to the invention, even if the usually still admissible height offset between the two anti-climbing devices 2, 2' is exceeded, guarding engagement is still possible. In the instant case, the left anti-climbing device 2 is higher than the right one 2' and the central bulged (right) front portion 4' has been pushed into the central cutout 5 of the left anti-climbing device 2 in the illustration as shown in FIG. 9*d*.

Further, the centering surfaces 8, which cooperate with the curvature of the antagonist anti-climbing device 2', permit to achieve centering in the horizontal direction whereas the fixing surface 9 of the guard plate 10, which cooperates with the front portion 4', ensures blocking in the vertical direction.

It is understood that the invention may also forgo the formation of ribs 7, which is actually the case in the embodiments described herein after. In the event of lighter and "ideal" collisions however, the ribs may be of decided advantage. The important point in this invention is the exact definition of the sequence of movements resulting from cooperation of the central front portions with the central cutouts, which determines but one single position for snap-fit engagement.

In the embodiment in accordance with the FIGS. 10 through 15, the anti-climbing device 2 is also convexly rounded at its front side, thereby forming a central, bulged front portion 4, but at the underside of the projecting front portion 4 there is now provided a guide surface 12 that is located between the centering surfaces 8 and extends at an incline downward and rearward from the front edge of the front portion 4. Put another way, the front portion 4 has a central region that tapers forward to a point.

Figure 11:
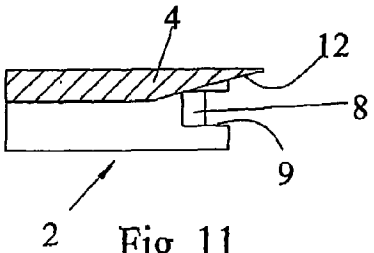
Figure 13:
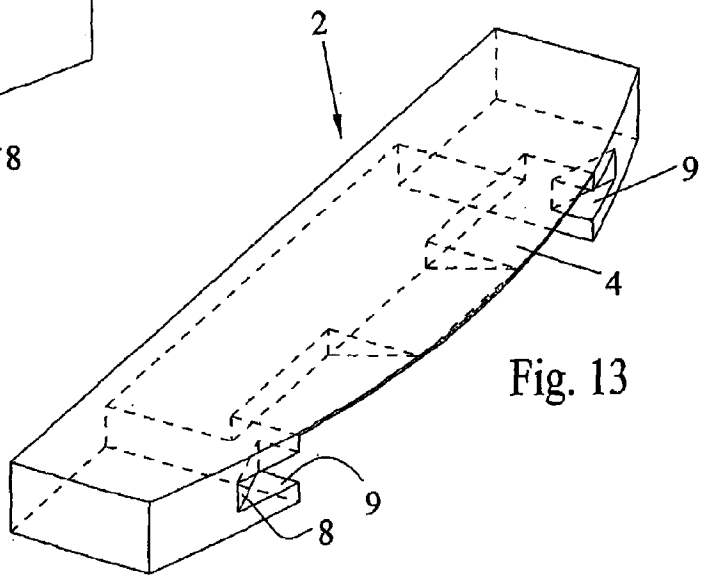
Figure 10:
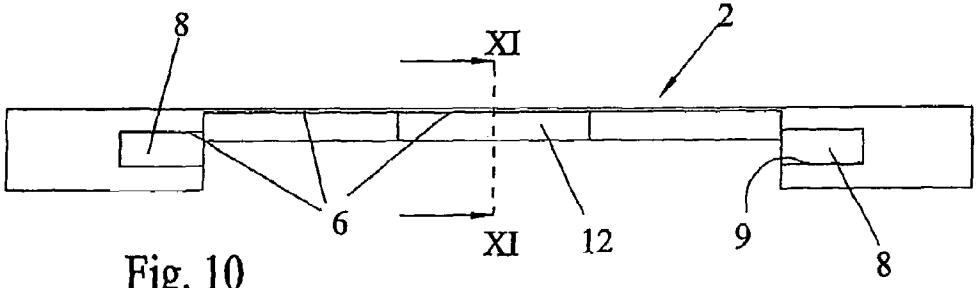
Figure 12:
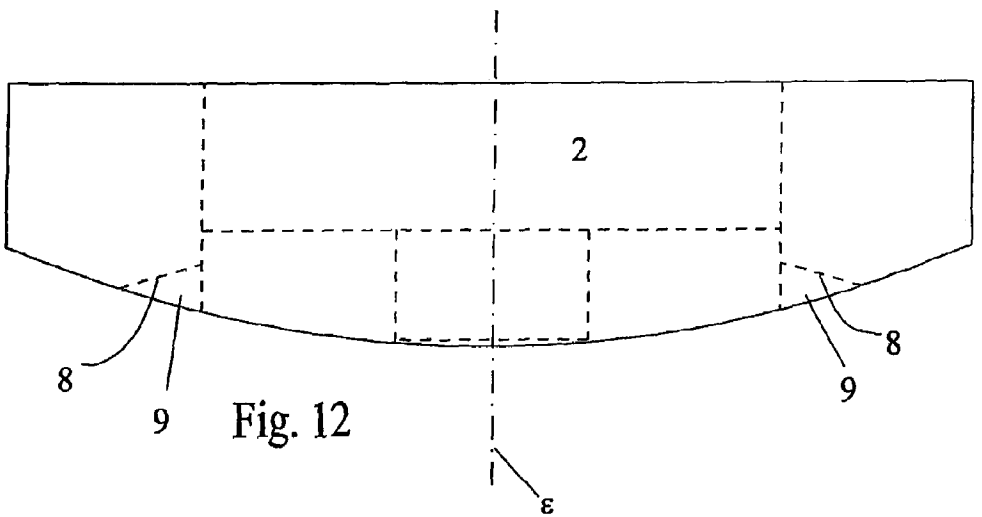

The incline of the guiding surface 12 almost forms a cutting edge, which can be clearly seen from FIG. 11. By contrast, the embodiment of the invention shown herein does not have a plurality of ribs at the front portion 4 as this was the case with the first embodiment. Like in the previous embodiment, the entire front surface of the anti-climbing device 2 of this embodiment may also be covered with a shell that is made for example from a glass fiber reinforced plastic or from not too thick a metal sheet. The function of the guiding surface 12 of this embodiment substantially is to ensure a defined height offset between the two carriage ends in the event of a collision.

Figure 14:
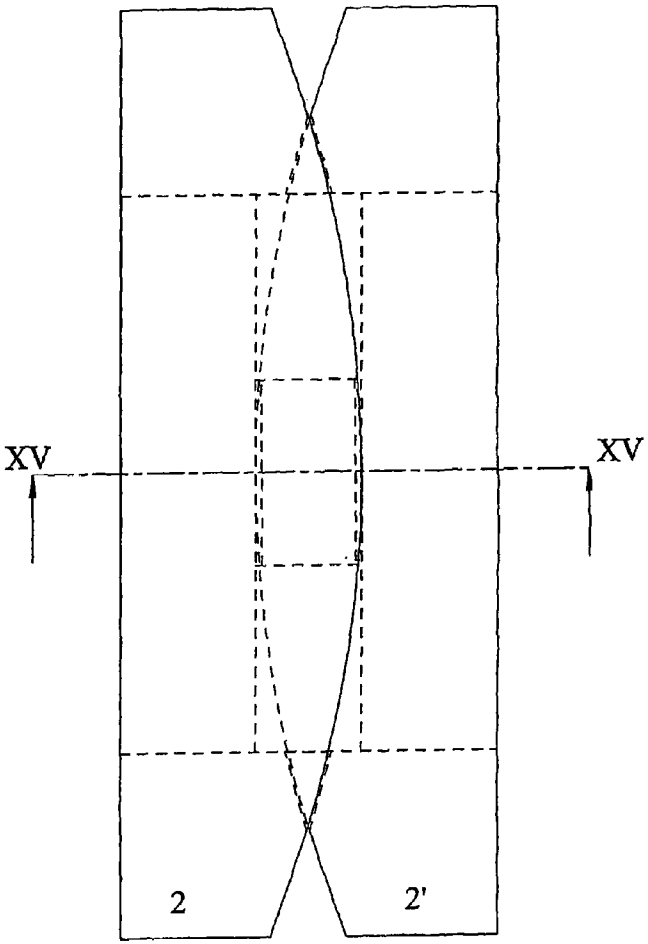
Figure 15:
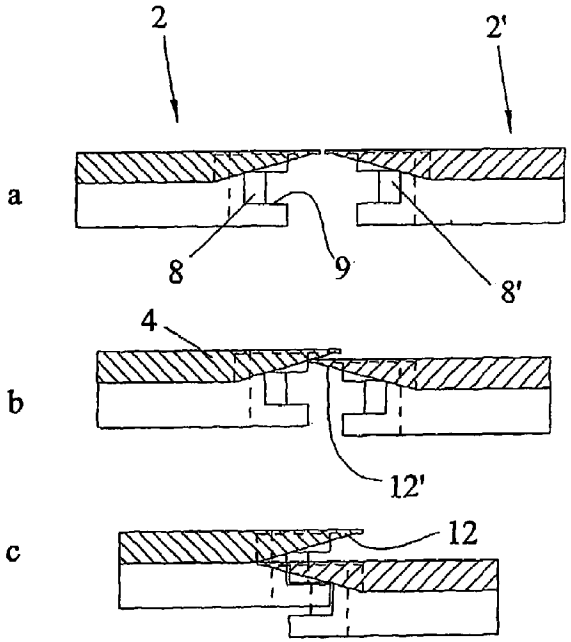
Figure 17:
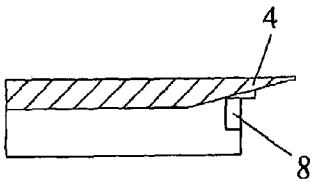
Figure 16:
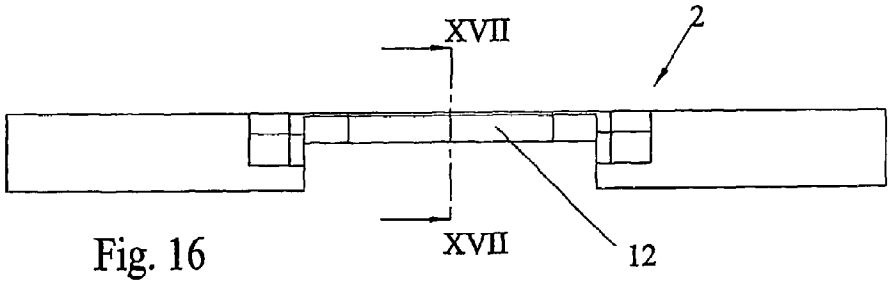
Figure 18:
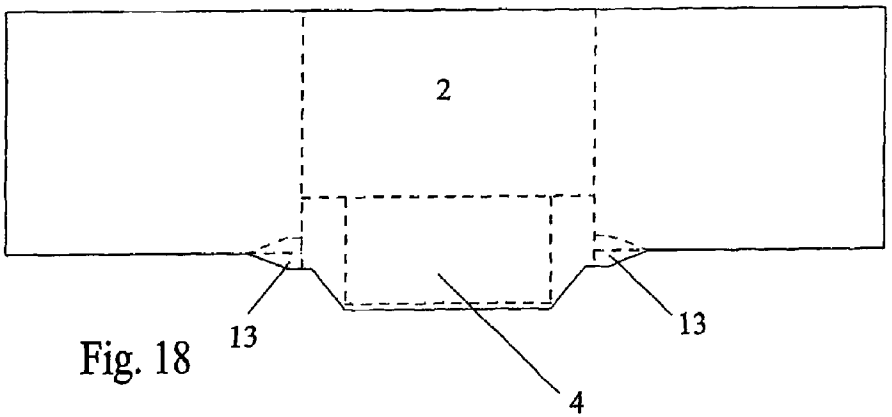
Figure 19:
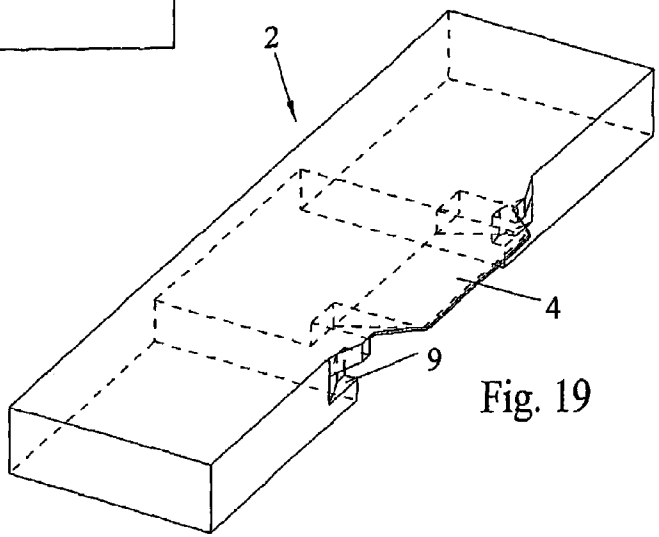

The function of the anti-climbing device 2 of the second embodiment can be seen from the FIGS. 14 and 15. FIG. 15*a* shows the anti-climbing devices 2, 2' of two colliding carriages shortly before the collision. As soon as the collision has occurred, the incline of the guiding surface 12 causes the two anti-climbing devices 2, 2' and as a result thereof the carriage ends to move into the desired position. Accordingly, the carriage ends are forced to move vertically in a precisely defined way, this vertical movement allowing in a second phase the locking and centering of the two car bodies relative to each other, the centering surfaces 8 already discussed in conjunction with the first embodiment coming also into effect here.

In this embodiment, the space above the coupling remains largely free so that there remains more space available for the coupling, the compressed air and the electrical equipment. Since the forces are introduced further on the outside, they are introduced in closer proximity to the sole bar which transmits the main force in the longitudinal direction of the carriage. Also, the different vertical offset of the two anti-climbing devices is particularly taken into account; there are only two possible ways of introducing the forces, viz. the one shown in FIG. 15 or a mirror-inverted one. Again, the centering in the horizontal direction ensures that the sacrificial elements mounted in the carriage end are loaded in a defined way.

The third embodiment of an anti-climbing device 2 of the invention illustrated in the FIGS. 17 through 21 is configured to be straight at its front side and is accordingly suited for straight carriage ends.

Figure 20:
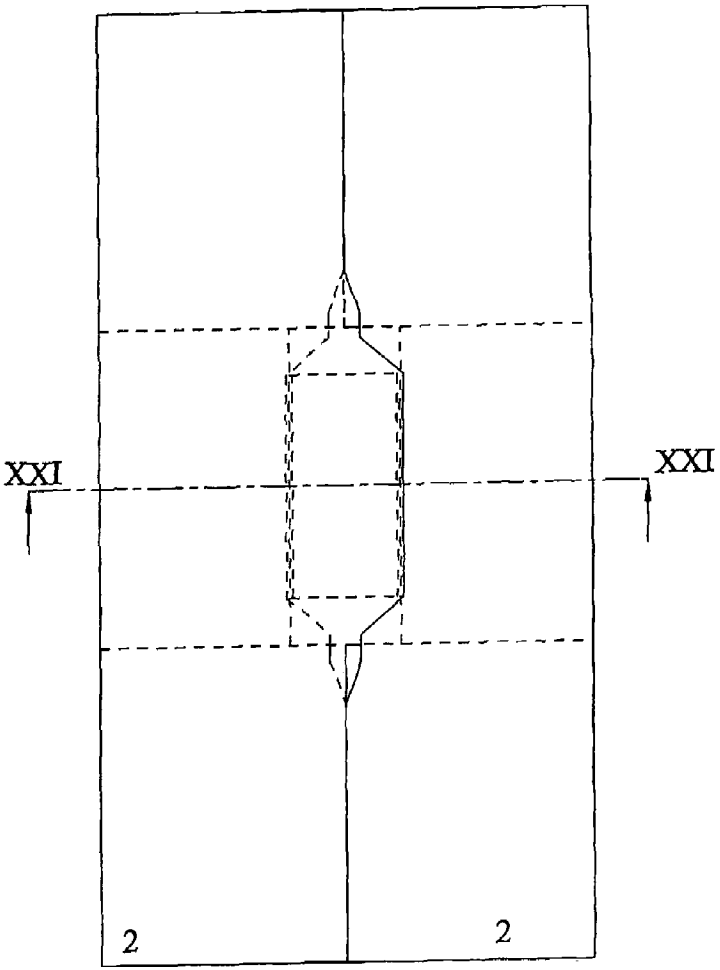
Figure 21:
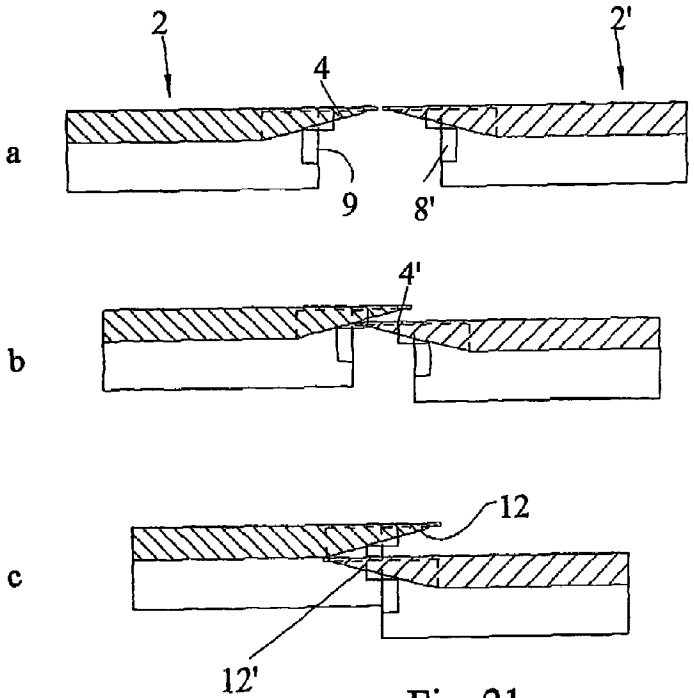

Above the guiding surface 12 which extends at an incline downward and rearward and is in principle configured in much the same way as in the second embodiment, the central front portion 4 projects beyond the front wall of the anti-climbing device 2. This projecting front portion may also be used for an intercar gangway between two railway carriages. The functioning shown in the FIGS. 20 and 21 is much the same as in the embodiment discussed previously so that further explanations are not necessary. The important point here also is the centering and locking both in the vertical and in the horizontal direction.

Again, the space above the coupling remains largely free and the other advantages mentioned in conjunction with the second embodiment likewise apply here.

The three variants of the invention described herein above represent but a small selection of the possible embodiments. Depending on the type of railbound vehicle, its application and possible requirement placed on aesthetics, many variants are possible within the scope of the invention. More specifically, the centering surfaces 8, the fixing surfaces 9 and the guiding surfaces 12 may have other proportions with respect to the overall dimensions of the anti-climbing device 2. Since certain inclined surfaces of the antagonist anti-climbing device always have to cooperate with the fixing surfaces 9, mating "convex" portions are provided on the anti-climbing device. As can be seen for example from FIG. 18, mating convex portions 13 of the front side of the anti-climbing device are provided in the third embodiment.

The invention claimed is:

1. An anti-climbing device (2) for railway carriages which is fixed at least at one end of a carriage at a defined height and extends over at least part of the carriage width, characterized in that, for cooperation with a front portion (4') of an anti-climbing device (2') of another carriage in a rear-end collision situation, a central cutout (5), which is open toward the bottom and bounded by a guard surface (6) toward the top, and two centering surfaces (8) laterally bounding said cutout (5) is provided beneath a projecting central front portion (4), a substantially horizontal fixing surface (9) adjoining the lower end of each centering surface (8) and that the centering surfaces (8) converge inward at an incline with respect to the vertical center plane (ϵ) of the carriage.

2. The anti-climbing device (2) as set forth in claim 1, characterized in that each fixing surface (9) is formed by the top side of a lateral guard plate (10).

3. The anti-climbing device (2) as set forth in claim 1, characterized in that the centering surfaces (8) and the fixing surfaces (9) are formed by lateral indentations (11) provided in the anti-climbing device (2).

4. The anti-climbing device (2) as set forth in claim 1, characterized in that said anti-climbing device has a front face with ribs (7).

5. The anti-climbing device (2) as set forth in claim 1, characterized in that a guide surface (12) inclined downward and rearward is provided on the underside of the projecting front portion (4).

6. The anti-climbing device (2) as set forth in claim 1, characterized by a convexly rounded front side extending substantially across the entire width of the carriage, thereby forming said projecting central front portion (4).

7. The anti-climbing device (2) as set forth in claim 1, characterized in that said anti-climbing device is at least partially covered with a facing that is readily destructible in the event of a collision.

8. A railway carriage having an anti-climbing device (2) as set forth in claim 1.

9. The railway carriage as set forth in claim 8, characterized in that the central projecting front portion (4, 4') is the base of a connection between railway carriages.

* * * * *

UNITED STATES PATENT AND TRADEMARK OFFICE

CERTIFICATE OF CORRECTION

PATENT NO. : 7,694,633 B2
APPLICATION NO. : 10/560222
DATED : April 13, 2010
INVENTOR(S) : Wilhem Mayer It is certified that error appears in the above-identified patent and that said Letters Patent is hereby corrected as shown below:

Title Page and Col. 1

Please change "(54) ANTI-CLIMBING DEVICE FOR RAILAY CARRIAGES"

to: --ANTI-CLIMBING DEVICE FOR RAILWAY CARRIAGES--.

Signed and Sealed this

Seventeenth Day of August, 2010

David J. Kappos

David J. Kappos
*Director of the United States Patent and Trademark Office*